US008309194B2

(12) United States Patent
Barredo

(10) Patent No.: US 8,309,194 B2
(45) Date of Patent: Nov. 13, 2012

(54) ROLL OF SHEETS OF ABSORBENT PRODUCT OF THE BATHROOM TISSUE TYPE

(75) Inventor: Donald Barredo, Ingersheim (FR)

(73) Assignee: Georgia-Pacific France, Kunheim (FR)

( * ) Notice: Subject to any disclaimer, the term of this patent is extended or adjusted under 35 U.S.C. 154(b) by 317 days.

(21) Appl. No.: 12/594,970

(22) PCT Filed: Apr. 3, 2008

(86) PCT No.: PCT/FR2008/000459

§ 371 (c)(1),
(2), (4) Date: Oct. 7, 2009

(87) PCT Pub. No.: WO2008/142264

PCT Pub. Date: Nov. 27, 2008

(65) Prior Publication Data

US 2010/0051219 A1 Mar. 4, 2010

(30) Foreign Application Priority Data

Apr. 13, 2007 (FR) ..... 07 02685

(51) Int. Cl.
*B32B 3/00* (2006.01)
*D21H 11/00* (2006.01)

(52) U.S. Cl. ..... 428/43; 428/172; 428/906; 162/109

(58) Field of Classification Search ..... 428/43, 428/906, 172; 162/123, 109
See application file for complete search history.

(56) References Cited

U.S. PATENT DOCUMENTS

| | | | |
|---|---|---|---|
| 901,723 | A | 10/1908 | Morse |
| D40,046 | S | 6/1909 | Stone |
| D40,322 | S | 10/1909 | Gair |
| D40,916 | S | 9/1910 | Gair |
| D63,341 | S | 11/1923 | Vandergaw et al. |
| D66,158 | S | 12/1924 | Vandergaw et al. |
| D66,341 | S | 12/1924 | Vandergaw et al. |
| D78,011 | S | 3/1929 | Currier et al. |
| D78,641 | S | 5/1929 | Manus |
| 1,983,813 | A | 12/1934 | Shy |
| D104,006 | S | 4/1937 | Goodstein |
| D113,598 | S | 2/1939 | Lawson |
| D118,716 | S | 1/1940 | Zito |
| D127,228 | S | 5/1941 | Erhard |

(Continued)

FOREIGN PATENT DOCUMENTS

DE 2238005 A1 2/1974

(Continued)

OTHER PUBLICATIONS

English Abstract for EP1845193A—Oct. 17, 2007.

(Continued)

*Primary Examiner* — Alexander Thomas
(74) *Attorney, Agent, or Firm* — Drinker Biddle & Reath LLP

(57) ABSTRACT

A roll for use as bathroom tissue is formed of a rolled strip of a cellulose-fiber product, the strip including at least three superposed and associated plies and having a tensile strength $R_{ST}$ across its width (1). The product P of the total thickness E of the strip times its strength $R_{ST}$ is greater than 190 mm*N/m, E being expressed in mm and $R_{ST}$ in N/m.

16 Claims, 1 Drawing Sheet

U.S. PATENT DOCUMENTS

| | | | | |
|---|---|---|---|---|
| D130,965 | S | 12/1941 | Fitch | |
| D154,344 | S | 6/1949 | Stapler | |
| D159,479 | S | 8/1950 | Feder | |
| 2,956,564 | A | 10/1960 | Shoji | |
| 3,377,224 | A | 4/1968 | Gresham et al. | |
| 3,738,905 | A | 6/1973 | Thomas | |
| D243,471 | S | 2/1977 | Schroeder | |
| 4,601,938 | A | 7/1986 | Deacon et al. | |
| 4,759,967 | A | 7/1988 | Bauernfeind | |
| 4,978,565 | A | 12/1990 | Pigneul et al. | |
| 5,173,351 | A | 12/1992 | Ruppel et al. | |
| D367,764 | S | 3/1996 | Makoui et al. | |
| D414,345 | S | 9/1999 | Barnholtz et al. | |
| 5,972,456 | A | 10/1999 | Esquivel | |
| D421,528 | S | 3/2000 | Shakora | |
| D425,354 | S | 5/2000 | Rogers et al. | |
| D436,737 | S | 1/2001 | Presutti | |
| D450,934 | S | 11/2001 | Duritsch et al. | |
| 6,461,705 | B2 | 10/2002 | Eichhorn | |
| 6,551,691 | B1 * | 4/2003 | Hoeft et al. | 428/172 |
| 6,599,614 | B1 | 7/2003 | Roussel et al. | |
| D494,766 | S | 8/2004 | Boerschinger et al. | |
| 6,805,766 | B1 | 10/2004 | Roussel et al. | |
| D502,004 | S | 2/2005 | Olson et al. | |
| 6,884,492 | B2 | 4/2005 | Basler et al. | |
| D508,613 | S | 8/2005 | Knobloch et al. | |
| D510,434 | S | 10/2005 | Carlucci et al. | |
| D518,647 | S | 4/2006 | Kressner et al. | |
| D518,965 | S | 4/2006 | Enderby | |
| D521,250 | S | 5/2006 | Knobloch et al. | |
| D521,251 | S | 5/2006 | Enderby | |
| D523,644 | S | 6/2006 | Knobloch et al. | |
| D530,520 | S | 10/2006 | Leclere et al. | |
| D535,107 | S | 1/2007 | Knobloch et al. | |
| D612,156 | S | 3/2010 | Barredo et al. | |
| D612,157 | S | 3/2010 | Barredo et al. | |
| 7,862,686 | B2 * | 1/2011 | Ward et al. | 162/123 |
| 2003/0203164 | A1 | 10/2003 | Healy et al. | |
| 2003/0215605 | A1 | 11/2003 | Muller | |
| 2004/0103591 | A1 | 6/2004 | Chornenky et al. | |
| 2006/0062972 | A1 | 3/2006 | Lefebvre Du Grosriez et al. | |
| 2006/0113049 | A1 | 6/2006 | Knobloch et al. | |
| 2008/0245693 | A1 * | 10/2008 | Vinson | 206/412 |
| 2009/0162597 | A1 | 6/2009 | Barredo et al. | |
| 2010/0112264 | A1 | 5/2010 | Barredo | |
| 2010/0326612 | A1 * | 12/2010 | Hupp et al. | 162/109 |

FOREIGN PATENT DOCUMENTS

| | | | |
|---|---|---|---|
| EP | 0264676 | A1 | 4/1988 |
| EP | 0864014 | B1 | 1/2002 |
| EP | 1353010 | A1 | 10/2003 |
| EP | 1400199 | A | 3/2004 |
| EP | 1428654 | A1 | 6/2004 |
| EP | 1845193 | A1 | 10/2007 |
| FR | 2653793 | B1 | 1/1992 |
| FR | 2775698 | A1 | 9/1999 |
| WO | 97/20107 | A1 | 6/1997 |
| WO | 98/52745 | A1 | 11/1998 |
| WO | 2006027810 | A1 | 3/2006 |

OTHER PUBLICATIONS

PCT International Search Report for International Application No. PCT/FR2008/000459 filed Apr. 3, 2008; International Publication No. WO 2008/142264; International Publication Date: Nov. 27, 2008.

English translation of International Preliminary Report on Patentability for PCT/FR2008/000459 dated Nov. 3, 2009.

* cited by examiner

ROLL OF SHEETS OF ABSORBENT PRODUCT OF THE BATHROOM TISSUE TYPE

BACKGROUND OF THE INVENTION

The present invention relates to the field of tissue products for sanitary or domestic use and is aimed in particular at products in rolls, such as rolls of bathroom tissue (or toilet paper) and the like.

The subject of the present invention is a roll made up of items based on (or essentially made of) a cellulose-fiber product. More specifically and according to an embodiment, the subject of the invention is a roll in which certain sheets, and more specifically in which each sheet of which it is made, has particular features associated with its thickness and its tensile strength.

Products of the aforementioned type packaged in the form of rolls are already known, in general. In these rolls, the sheets of product to be dispensed are customarily rolled onto a central core of cylindrical cross section made of cardboard or the like. In the field in question, the rolled sheets of interest to the user are conventionally made from cellulose-fiber products made of (or predominantly made of) tissue and assembled in the form of one or more bonded superposed plies, it being possible for the sheets to be separated from one another, in the direction perpendicular to the direction in which the sheets are unrolled, along perforated, so-called precut, lines allowing one or more sheets to be torn or removed from the roll.

In the case of rolls of multi-ply sheets, the various superposed plies are, depending on the use for which the sheet is intended and/or on the requirements dictated by the consumers and/or production constraints, held together more or less securely depending on the various techniques used to assemble the plies.

Most often, the plies in a multi-ply product made essentially of tissue are associated by applying an adhesive between the plies. The adhesive bonding is performed using any adhesive product generally used in the field of sanitary and domestic papers for combining plies with one another, such as, for example a polyvinyl alcohol in aqueous solution. This association by adhesive bonding may be combined with another type, which is also conventional, of combination of plies which is purely mechanical and consists in locally deforming the plies by crushing them so that the plies, imbricated in one another under the pressure of a cylinder, are held together once the association operation is over.

Upwards of a certain number of plies that need to be associated, particularly when more than three plies or groups of plies are to be associated, various kinds of problems may arise.

First of all, there are purely technical problems of associating the plies. There are various known ways of overcoming these. However, in most cases, the thick sheets are not flexible. "Thick" here means "more than 0.75 mm thick".

Furthermore, it is known that the thickness may detract from the bond between the successive sheets, at the precut lines which usually form the connection between the sheets that form the roll. Problems of breakage here have already been observed: for example, the sheets become detached from one another while they are still on the roll itself.

Surprisingly and unexpectedly, the rolls according to the invention do not display such disadvantages.

Furthermore, sheets that are excessively rigid are unsuitable for use as bathroom tissue.

Incidentally, as far as the making of rolls is concerned, the sheets of which the rolls are formed need to be able to be rolled up easily, even at the center of the roll where the radius of curvature is the smallest.

Another parameter that is very important to applications to bathroom tissue has to do with the thickness and the strength, in the dry state, of the sheets of which the roll is formed.

BRIEF DESCRIPTION OF THE INVENTION

As can be seen from the table hereinafter, and contrary to received wisdom, when the existing products are thick, they are not particularly strong for all that, particularly in the transverse direction, that is to say in the direction perpendicular to the direction in which the roll is unrolled.

Now, for use as bathroom tissue, it is very important for the product to be both thick and strong.

Thus, an embodiment of the invention is a roll for use as bathroom tissue, formed of a rolled strip of a cellulose-fiber product, the strip having at least three superposed and associated plies, the strip having a tensile strength $R_{ST}$ across its width.

According to an embodiment of the invention, the product P of the total thickness E of the strip times its strength $R_{ST}$ is greater than 190 mm*N/m, E being expressed in mm and $R_{ST}$ in N/m: $P=E\times R_{ST}$ and $P>190$ mm*N/m.

This feature in particular ensures comfort and dependability of use which are entirely remarkable, novel and unexpected.

Embodiments of the invention therefore relate to a multiply product where "ply" may be understood to mean a group of plies in that a group of plies is a collection of several plies that are superposed and associated with one another in the wet phase.

According to an embodiment of the invention, at least one of the plies of which said strip is formed is wet laid using a technique of the TAD type.

The ply of the TAD type may be positioned in such a way as to be visible on the outside of the roll.

According to an embodiment of the invention, at least one of the plies of which said strip is formed is wet laid using a technique of the CWP type.

According to an embodiment of the invention, the basis weight of the strip ranges between 30 and 150 g/m$^2$, preferably between 85 and 115 g/m$^2$.

BRIEF DESCRIPTION OF THE DRAWINGS

Other features, details and advantages of the present invention will become better apparent from reading the description which will follow, given by way of entirely nonlimiting illustration and with reference to the attached drawings in which.

DETAILED DESCRIPTION OF THE INVENTION

Figure 1:
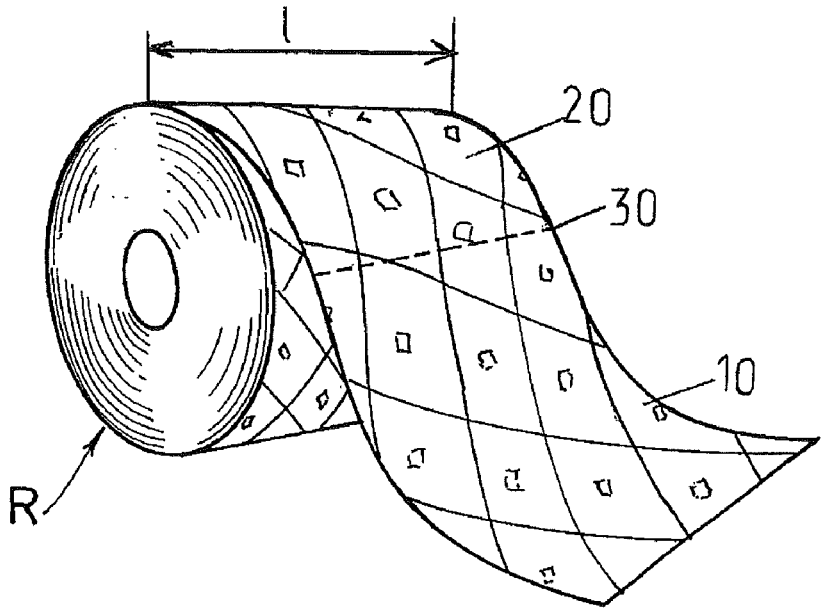
FIG. 1 is an example of a roll according to an embodiment of the invention.

Referring to FIG. 1, a roll R according to an embodiment of the invention is first and foremost intended for use as bathroom tissue. Such a roll corresponds to the following definition: an external diameter in excess of 60 mm, usually of the order of about 100 mm, but which can be as much as 200 or even 300 mm in the case of rolls for away from home use.

The strip of tissue of which the rolls at which the invention is aimed are formed may have a width ranging between 80 and 120 mm and may or may not have precuts (30) running transversal to its length, preferably at regular intervals.

When the precuts (30) are present, a succession of sheets (10, 20) is therefore formed, and, within the meaning of the invention, it is considered that a sheet for use as bathroom tissue has a length ranging between 90 mm and 250 mm, and a width ranging between 80 mm and 120 mm.

Furthermore, the sheets are joined together by perforations and tabs, the percentages of which may vary from 10 to 70%; the perforations (or incisions) may or may not be uniformly distributed across the width of the strip.

The basis weight of such strips ranges between about 70 g/m$^2$ and 150 g/m$^2$.

Furthermore, each ply of which the rolled strip is formed may be made beforehand using the wet laid technique known as CWP, which is well known to those skilled in the art and will not be explained further.

The multi-ply rolled strip according to an embodiment of the invention may comprise only plies formed in this way.

Without departing from the scope of the invention, the plies may be wet laid using a TAD (through air drying) technique which is known per se and which, overall, involves spraying a collection of papermaking fibers onto a screen to form a mat, transferring this mat onto the surface of a porous drying cylinder, forcing jets of air from the cylinder through the mat then transferring the plies thus formed onto what is known as a creping cylinder. One or more plies are thus formed.

Wet laid plies according to the teaching of application EP 1 353 010 may also form part of a sheet according to the invention.

The plies may be associated using an installation that may or may not include an adhesive application unit.

The invention also relates to multi-ply sheets having both plies obtained using a conventional (CWP) technique and plies produced using the TAD technique.

The plies of the TAD type may constitute the two exterior faces of such sheets. A very gentle feel is therefore obtained. The internal plies may be produced using a CWP or some other technique.

Without departing from the scope of the invention, the external plies may be wet laid using a conventional (CWP) technique and form the two exterior faces of the sheet. In this configuration, the internal plies may be produced using a TAD type technique.

Of course, a combination of plies aimed at obtaining a sheet that has one face formed of a conventional ply and one face formed using a TAD type technique may also be produced without departing from the scope of the invention.

One or the other of the combinations will be selected according to the particular case, that is to say according to the feel, the absorption, the flexibility most desired, or alternatively according to constraints of an economic nature.

Figure 2:
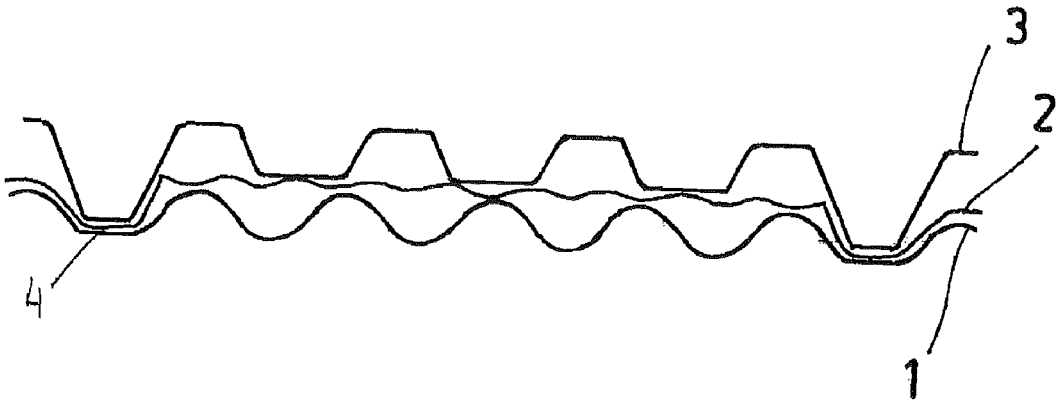
FIG. 2 is a cross section of a sheet according to one embodiment of the invention.

FIG. 2 provides an example of a sheet comprising three plies 1, 2, 3 which are superposed and associated with one another at certain points 4.

Furthermore, it is perfectly conceivable to produce a rolled strip according to the invention without using any adhesive to associate the plies, whatever the nature of each of the plies (or group of plies) of which the rolled strip is formed.

In a way which is novel and unexpected it was found that a roll for use as bathroom tissue formed of a rolled strip in which the thickness and the strength in the transverse direction was such that $P=E\times R_{ST}>190$ mm*N/m had appreciable advantages over the prior art.

The comparative table below gives the following values:

| Product | Thickness mm | Strength ST N/m | Product $E \times R_{ST}$ |
|---|---|---|---|
| INV 9 plies | 1.11 | 392 | 435.1 |
| INV TAD 5 plies (1TAD + 3CWP) | 0.77 | 365 | 281.1 |
| INV 6 plies | 0.9 | 260 | 234.0 |
| INV TAD 5 plies (2TAD + 1CWP) | 0.93 | 242 | 225.1 |
| INV 7 plies | 0.94 | 234 | 220.0 |
| Moltonel | 0.62 | 180 | 111.6 |
| Lotus Confort | 0.32 | 97 | 31.0 |
| Lotus Petite Fleur | 0.33 | 87 | 28.7 |

In this table, $R_{ST}$ is the tensile strength of the rolled strip in a direction perpendicular to the direction in which the roll is unrolled.

The "tensile strength" or, more specifically, the "resistance to breakage by pulling" defined in standard NF EN 12625-4, part 4, is the maximum tensile force withstood per unit width by a specimen of tissue paper or tissue product until it breaks, in a tensile test. The principle of this test is to stretch a specimen 50 mm wide and at least 250 mm long at a constant rate of elongation of 50 mm/min until it breaks.

To do this, the specimens to be evaluated are placed in succession between two jaws of a tester (as defined in detail in EN 12625-4): at least 20 specimens are subjected to the test.

The jaws of the tester separate from one another at a constant rate of about 50 mm/min, all the significant values of the forces as the specimens break are recorded.

The mean of said rupture (breaking) forces: F (expressed in N) is then calculated in order to determine the mean tensile rupture strength Fm expressed in N/m such that:

$$Fm = \frac{F \times 10^3}{Wi}$$

where Wi=the initial width of the specimen (normally 50 mm).

For the preferred applications of the invention, $R_{ST}$ ranges between 200 and 500 N/m and preferably exceeds 250 N/m.

E is the measured thickness of the sheet (or of the strip) obtained using European standard EN 12626-3 while Ep is the mean thickness of a ply of the sheet. More specifically, Ep is the total thickness of the sheet divided by the number of plies of which the sheet (in a strip) is formed.

Within the meaning of the invention, the thickness E ranges between 0.75 and 1.5 mm, and is preferably around 0.90 mm.

The comparative table above clearly shows that the products according to the prior art, namely those corresponding to the last three rows of the table and identified as "MOLTONEL", "LOTUS CONFORT" and "LOTUS PETITE FLEUR" represent a product P of less than 190 mm·N/m.

The "MOLTONEL", "LOTUS CONFORT" and "LOTUS PETITE FLEUR" products correspond to rolls of bathroom tissue manufactured and marketed by the applicant company under these three registered trade names and the sheets of which consist of two or three plies of the CWP type.

Values presented herein are provided in international units, where N is Newton, m is meter, mm is millimeter, g is gram.

The invention claimed is:

1. A roll for use as bathroom tissue, formed of a rolled strip of a cellulose-fiber product, said strip comprising:

at least three superposed and associated plies, said strip having a tensile strength $R_{ST}$ across its width (1) such that a product P of the total thickness E of the strip times its strength $R_{ST}$ is greater than a value obtained when a thickness of 0.75-1.5 mm is multiplied by a tensile strength of 200-500 N/m, E being expressed in mm and $R_{ST}$ in N/m, wherein:

at least one of the plies comprises one of a wet pressed ply or a through air dried ply, another one of the plies comprises the other one of the wet pressed ply or the through air dried ply, and an exterior one of the plies is formed with a first pattern including a repeating pattern of deep and shallow angular cross-sectional shapes and the other exterior one of the plies is formed with a second pattern including a repeating pattern of shallow wavy cross-sectional shapes.

2. The roll as claimed in claim 1, further comprising a succession of sheets that can be separated from one another along associated precut lines.

3. The roll as claimed in claim 1, wherein each ply of which said strip is formed comprises a group of plies.

4. The roll as claimed in claim 1, wherein a basis weight of said strip ranges between 30 and 150 g/m$^2$.

5. The roll as claimed in claim 4, wherein the basis weight of said strip ranges between 85 and 115 g/m$^2$.

6. The roll as claimed in claim 1, wherein the product P is equal to or greater than 220 mm*N/m.

7. The roll as claimed in claim 1, wherein at least one external one of the plies comprises a wet pressed ply and an internal one of the plies comprises a through air dried ply.

8. The roll as claimed in claim 7, wherein the internal one of the plies comprises a single through air dried ply.

9. The roll as claimed in claim 1, wherein at least one external one of the plies comprises a through air dried ply and an internal one of the plies comprises a wet pressed ply.

10. The roll as claimed in claim 9, wherein the internal one of the plies comprises a single wet pressed ply.

11. The roll as claimed in claim 1, wherein an interior one of the plies has a random pattern.

12. A method of forming a bathroom tissue roll that is formed of a rolled strip of a cellulose-fiber product comprising at least three superposed and associated plies, said strip having a tensile strength $R_{ST}$ across its width (1) such that a product P of the total thickness E of the strip times its strength $R_{ST}$ is greater than a value obtained when a thickness of 0.75-1.5 mm is multiplied by a tensile strength of 200-500 N/m, the method comprising:

forming at least one of the plies using one of wet pressing or through air drying; and forming another one of the plies using the other one of the wet pressing or the through air drying, the method further comprising:

forming an exterior one of the plies with a first pattern including a repeating pattern of deep and shallow angular cross-sectional shapes; and forming the other exterior one of the plies with a second pattern including a repeating pattern of shallow wavy cross-sectional shapes.

13. The method as claimed in claim 12, further comprising:

forming at least one external one of the plies using wet pressing; and forming an internal one of the plies using through air drying.

14. The method as claimed in claim 13, wherein the forming of the internal one of the plies comprises using through air drying to form a single ply.

15. The method as claimed in claim 12, further comprising:

forming at least one external one of the plies using through air drying; and forming an internal one of the plies using wet pressing.

16. The method as claimed in claim 15, wherein the forming of the internal one of the plies comprises using wet pressing to form a single ply.

* * * * *